US005611382A

United States Patent [19]

Sferra

[11] Patent Number: 5,611,382

[45] Date of Patent: Mar. 18, 1997

[54] GARAGE DOOR SCREEN ASSEMBLY

[76] Inventor: Carl Sferra, 4608 Weybridge, Sarasota, Fla. 34235

[21] Appl. No.: 527,074

[22] Filed: Sep. 12, 1995

[51] Int. Cl.[6] ..... E06B 3/48

[52] U.S. Cl. ..... 160/113; 160/201

[58] Field of Search ..... 160/201, 87, 89, 160/90, 102, 103, 113, 118, 205, 188, 189

[56] References Cited

U.S. PATENT DOCUMENTS

| | | | |
|---|---|---|---|
| 2,072,092 | 3/1937 | Blodgett | 160/113 |
| 3,021,896 | 2/1962 | Buono et al. | 160/113 |
| 3,103,967 | 9/1963 | Gaschen | 160/113 |
| 3,126,944 | 3/1964 | Kempinski | 160/90 |
| 3,938,577 | 2/1976 | Richards | 160/90 |
| 4,231,412 | 11/1980 | Nowak | 160/113 X |
| 4,356,668 | 11/1982 | Wagner | 160/89 X |
| 4,378,043 | 3/1983 | Sorenson | 160/201 X |
| 4,653,566 | 3/1987 | Miale | 160/201 X |
| 5,050,660 | 9/1991 | Bleichwehl et al. | 160/113 |
| 5,408,789 | 4/1995 | Plfeger | 160/113 X |

*Primary Examiner*—David M. Purol
*Attorney, Agent, or Firm*—William E. Noonan

[57] ABSTRACT

A retractable screen assembly is disclosed for a standard garage door of the type that is selectively raised and lowered to open and close the garage. The assembly includes one or more screen panels stacked against and extending across an inside surface of the garage door. The panels are telescopically mounted to the garage door such that they are selectively positioned in a retracted condition wherein the panels are held in substantially parallel juxtaposition against the garage door, and an extended condition wherein the panels depend from the garage door and extend generally between the lower edge of the garage door and a floor of the garage when the garage door is raised. The panels are releasably locked in the retracted condition to permit the garage door to be raised with the panels in the retracted condition. The panels are released so that they slide into the extended condition when the garage door is raised.

17 Claims, 7 Drawing Sheets

GARAGE DOOR SCREEN ASSEMBLY

FIELD OF THE INVENTION

This invention relates to a garage door screen assembly and, more particularly, to an assembly that includes one or more screen panels stacked against and retractably mounted to an inside surface of a standard garage door.

BACKGROUND OF THE INVENTION

Household garages almost always suffer from poor ventilation. Most garages are not air conditioned and many lack windows. As a result, the air inside the garage tends to stagnate and become quite hot, particularly during warm weather months and in southern climates. When the garage is attached to the house, this heat will transfer quite easily to the inside of the home thereby decreasing the efficiency of the home's air conditioning system. Additionally, the interior of the garage tends to collect obnoxious odors from automobile exhaust and trash or garbage stored within the garage. These malodorous fumes tend to become trapped within a poorly ventilated garage and can eventually seep into the house. The hot, stagnant air and foul smells found within many garages makes them unpleasant environments in which to relax or perform household chores. Moreover, because garages are normally kept closed and many do not include windows, they tend to remain kept in darkness most of the time. This can cause mold and mildew to collect within the garage.

To date, the most effective way of improving the ventilation and lighting within the garage has simply been to open the garage door. However, this is often an impractical or even impossible solution. For example, during the hottest and sunniest periods of the day, the homeowner may be at work or otherwise away from home. For security reasons, the garage door cannot be left open unless someone is available to monitor the garage. Many deed restricted communities do not permit garage doors to be left open above a precise height for aesthetic purposes. And, leaving the door open to the garage permits insects to enter the garage. If garbage is stored in the garage, rodents and other pests may also be attracted.

Screen panels similar to those used in windows and screen doors have been employed to improve garage ventilation. However in order to install these panels, they must first be positioned between the bottom of the garage door and the floor of the garage. This can be a complicated and tedious task. Initially, the bottom of the garage door must be raised to a level above the screen panel. Then, the panel must be positioned in the garage door opening. While one person holds the panel, another person must lower the garage door until it engages the top of the panel to hold in into place. After the screen panel is removed, it must be stored in an appropriate location within the garage or elsewhere. To date, no automatically operated and permanently mounted screen assemblies for garage doors are known.

SUMMARY OF INVENTION

Accordingly, it is an object of this invention to provide an improved, retractable, permanently mounted screen assembly for a standard garage door.

It is a further object of this invention to provide a garage door screen assembly that significantly improves ventilation within the garage so that the inside temperature of the garage is reduced and stagnant air and bad odors lessened.

It is a further object of this invention to provide a screen assembly for a garage door that operates virtually automatically as the garage door is raised and lowered.

It is a further object of this invention to provide a screen assembly for a garage door that significantly improves garage lighting and air circulation, while maintaining privacy and security within the garage.

It is a further object of this invention to provide a garage door screen assembly that requires no exterior installation on the garage and which meets the requirements of most homeowner associations and deed restricted communities.

It is a further object of this invention to provide a screen assembly for a garage door that fits a variety of selected doorway heights.

It is a further object of this invention to provide a garage door screen assembly that causes the garage door to stop automatically at the desired height of the screen assembly.

It is a further object of this invention to provide a garage door screen assembly employing screen panels that are stored neatly, compactly and permanently against the inside bottom panel of the garage door so that garage clutter is reduced.

It is a further object of this invention to provide a garage door screen assembly that is quick and convenient to deploy when needed.

It is a further object of this invention to provide a screen assembly for a garage door that is permanently and retractably mounted to the inside of the garage door but which does not interfere with or affect the operation of the door when use of the screen assembly is not required.

It is a further object of this invention to provide a screen assembly for a garage door that enables the garage to be effectively employed as a screen enclosure and which prevents insects and pests from entering the garage.

This invention results from a realization that an improved garage door screen assembly may be accomplished by retractably or telescopically mounting one or more screen panels to the inside surface of the lowermost panel of the garage door. This invention results from a further realization that improved automatic operation of the screen assembly is achieved by mounting a limit switch adjacent to the garage door at the height of the deployed screen panel. That switch is operated by a complementary cam carried at the top of the screen panels to stop the garage door from being raised further when it reaches the height of the deployed panels.

This invention features a retractable screen assembly for a standard garage door that is selectively raised and lowered to open and close a garage. The assembly includes a screen panel that extends across an inside surface of the garage door. There are means for slidably mounting the screen panel to the inside surface of the garage door such that the panel is alternatable between a retracted condition wherein the panel is held in substantially parallel juxtaposition against the garage door with at least a majority of the panel positioned substantially above a bottom edge of the garage door, and an extended condition, wherein the panel generally depends from the lower edge of the garage door and engages a floor of the garage when the garage door is raised. There are means for releasably locking the panel in the retracted condition to permit the garage door to be raised with the panel in the retracted condition. The means for locking are released to permit the panel to be slid into the extended condition when the garage door is raised.

In a preferred embodiment the means for slidably mounting include a pair of elongate, parallel track members mounted to and extending generally vertically on one of the inside surface of the garage door and an inner face of the screen panel, and a complementary pair of slide members attached to the other of the inside surface of the garage door and the inner face of the screen panel. Each slide member is slidably engaged with a respective one of the track members.

The means for releasably locking may include a bracket secured to and extending inwardly from the garage door laterally outside of the screen panel. A latch element may be slidably mounted on the screen panel and alternatable between a locked condition wherein the latch element interengages the bracket to restrict relative movement between the screen panel and the garage door and an unlocked condition wherein the latch element is disengaged from the bracket to permit relative movement between the screen panel and the garage door.

Means may be provided for automatically raising the garage door. Means may be provided for deactivating the means for raising to stop the garage door when the door is in a predetermined raised condition. The means for deactivating may include switch means for alternating between a first state in which the means for raising are activated and a second state wherein the means for raising are deactivated. Switch actuator means may be attached to the garage door for engaging the switching means and alternating the switch means from the first state to the second state to deactivate the means for raising when the garage door is in the predetermined raised position. The switch actuator may include a cam and, in such cases, the switching means may include one of a microswitch and a toggle switch. Alternatively, the switching means may comprise a magnetic switch and the switch actuator may include a complementary magnet. The switch actuator may be carried by the bracket that is mounted to the garage door. The cam may be mounted to the bracket and resilient means may be employed to bias the cam in a laterally outward direction relative to the garage door. Guard means are typically attached to the screen panel for covering the switch actuator to prevent the actuator from engaging the switching means when the screen panel is in the retracted condition and the garage door is raised.

This invention also features a retractable screen assembly wherein a plurality of screen panels are stacked against and extend across the inside surface of the garage door. Means are provided for telescopically mounting the screen panels to the inside garage door surface such that the panels are selectively positioned in a retracted condition, wherein the panels are held in substantially parallel juxtaposition against the garage door with at least a majority of each panel located above a bottom edge of the garage door, and an extended condition, wherein the panels generally depend from the garage door and extend generally between the lower edge of the garage door and a floor of the garage when the garage door is raised. Again, means are provided for releasably locking the panels in the retracted condition. When the panels are unlocked and the garage door is raised, the panels slide into the extended condition.

In the multiple panel embodiment, an upper screen panel is slidably mounted to the inside surface of the garage door and a lower panel is slidably mounted to an inside surface of the upper panel. Additional lower panels may similarly be mounted to the inside surface of the lower panel such that three or more panels may be telescopically interconnected. The means for telescopically mounting may include complementary track and slide members, as in the single panel embodiment. Likewise, the means for releasably locking, the bracket, the switching means and the switch actuator of the single panel embodiment may be used in the multiple panel version.

BRIEF DESCRIPTION OF THE DRAWINGS

Other objects, features and advantages will occur from the following description of preferred embodiments and the accompanying drawings, in which.

DESCRIPTION OF PREFERRED EMBODIMENTS

Figure 1:
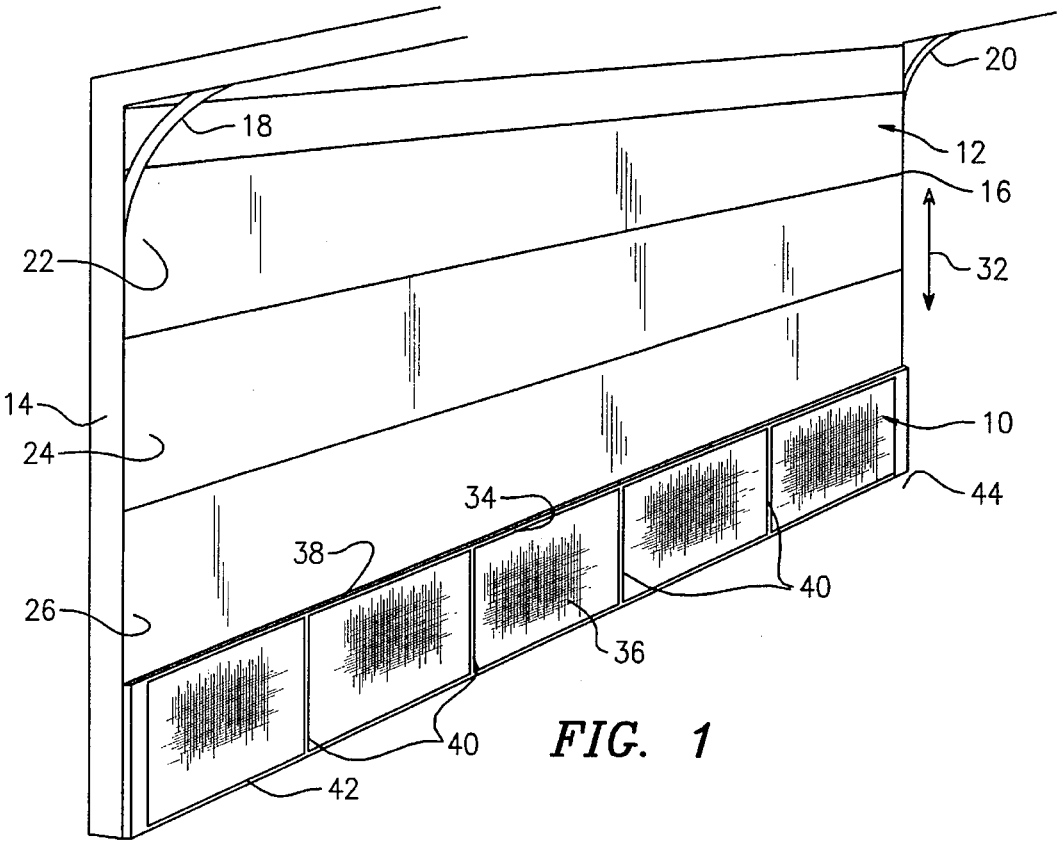
FIG. 1 is a perspective view of a single panel garage door screen assembly, in accordance with this invention, with the garage door lowered and the screen assembly in a retracted condition.
Figure 2:
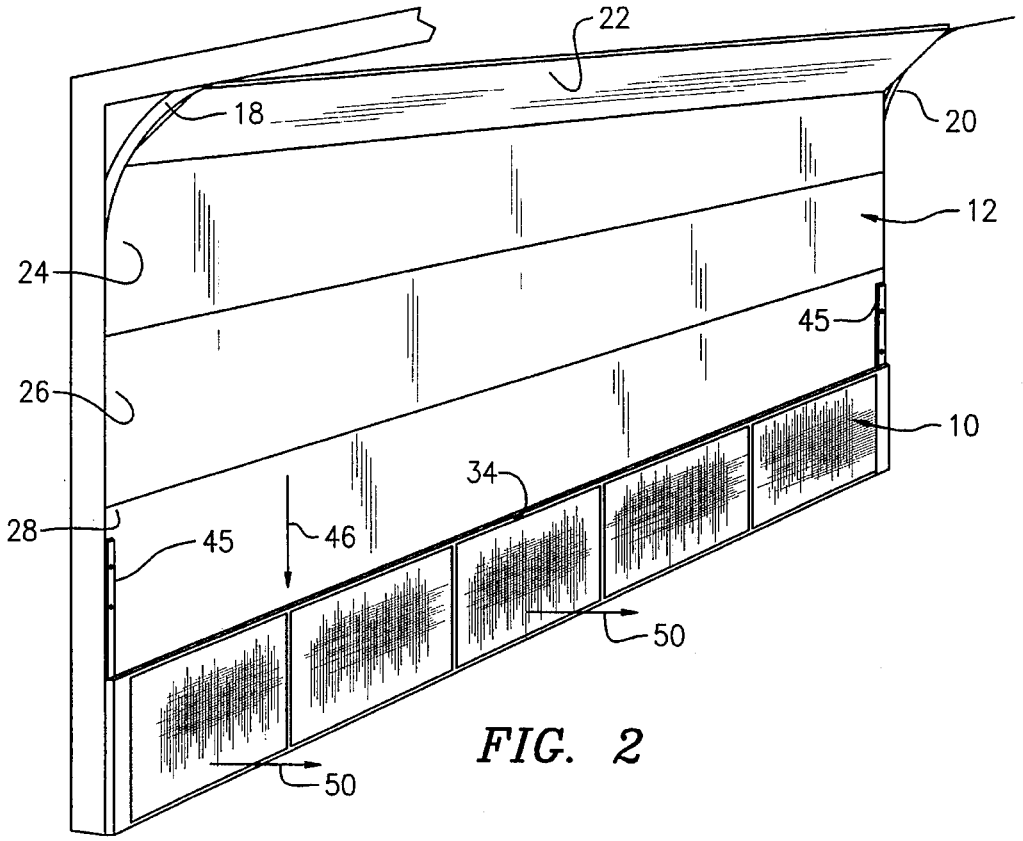
FIG. 2 is a similar perspective view of the garage door and screen assembly of FIG. 1, with the garage door raised and the screen assembly in an extended condition.

There is shown in FIGS. 1 and 2 a retractable screen assembly 10 that is operably mounted to a standard multiple panel garage door 12. The garage door extends both vertically and laterally across a garage doorway between casing portions 14 and 16. A pair of conventional metal tracks 18 and 20 are mounted interiorly adjacent to the sides of the doorway and casing portions 14 and 16. Door 12 is operably mounted in tracks 18 and 20 by a plurality of standard garage door rollers, not shown in FIG. 1 but see roller shafts 21 in FIG. 3. Door 12 includes four lateral panels 22, 24, 26 and 28 (the latter being obscured by assembly 10 in FIG. 1 but illustrated in FIGS. 2 and 3). These panels are hingedly interconnected as best shown by hinges 30 in FIG. 3. As a result, garage door 12 may be opened and closed by respectively raising and lowering the garage door in the directions indicated by double-headed arrow 32 in FIG. 1. More particularly, the door may be raised and lowered either manually or automatically through the use of a conventional garage door opener.

Screen assembly 10 includes a single screen panel 34 that extends across an inside surface of garage door 12 and, more particularly, across lowermost door panel 28. Panel 34 includes an inner mesh 36 that is surrounded by a peripheral frame 38. A plurality of vertical members 40 divide panel 34 into five discrete screen segments. In alternative embodiments, various other numbers of screen panel segments or simply a single segment may be employed. In any event, mesh 36 preferably comprises any known screen or mesh material that may be composed of various metals, metal alloys or plastics. The size of the mesh is similar to that used for known door and window screens. Frame 38 is composed of a suitable metal such as aluminum. Alternative metallic or plastic constructions may also be used. Mesh 36 is attached to frame 38 and to vertical members 40 in a known manner using conventional screen panel manufacturing techniques.

Screen assembly 10 generally conforms in size and shape to the lowermost panel 28 (FIGS. 2 and 3) of garage door 12. Specifically, panel 34 extends across the inside surface of the garage door for the entire width of the door. The height of panel 34 generally matches the height of the lowermost garage door panel. The panel is illustrated in the closed or retracted condition in FIG. 1. Therein, panel 34 is stacked generally parallel to and against the inside surface of the garage door. Virtually all of panel 34 is positioned above the bottom edge of garage door 12. Both the bottom edge 42 of panel 34 and the bottom edge of door panel 28 (which may carry a standard rubber or plastic lip) engage the floor 44 of the garage. In FIG. 1, the garage door is closed and assembly 10 is not deployed. Instead, panel 34 is effectively stored against the inside surface of door 12.

Figure 3:
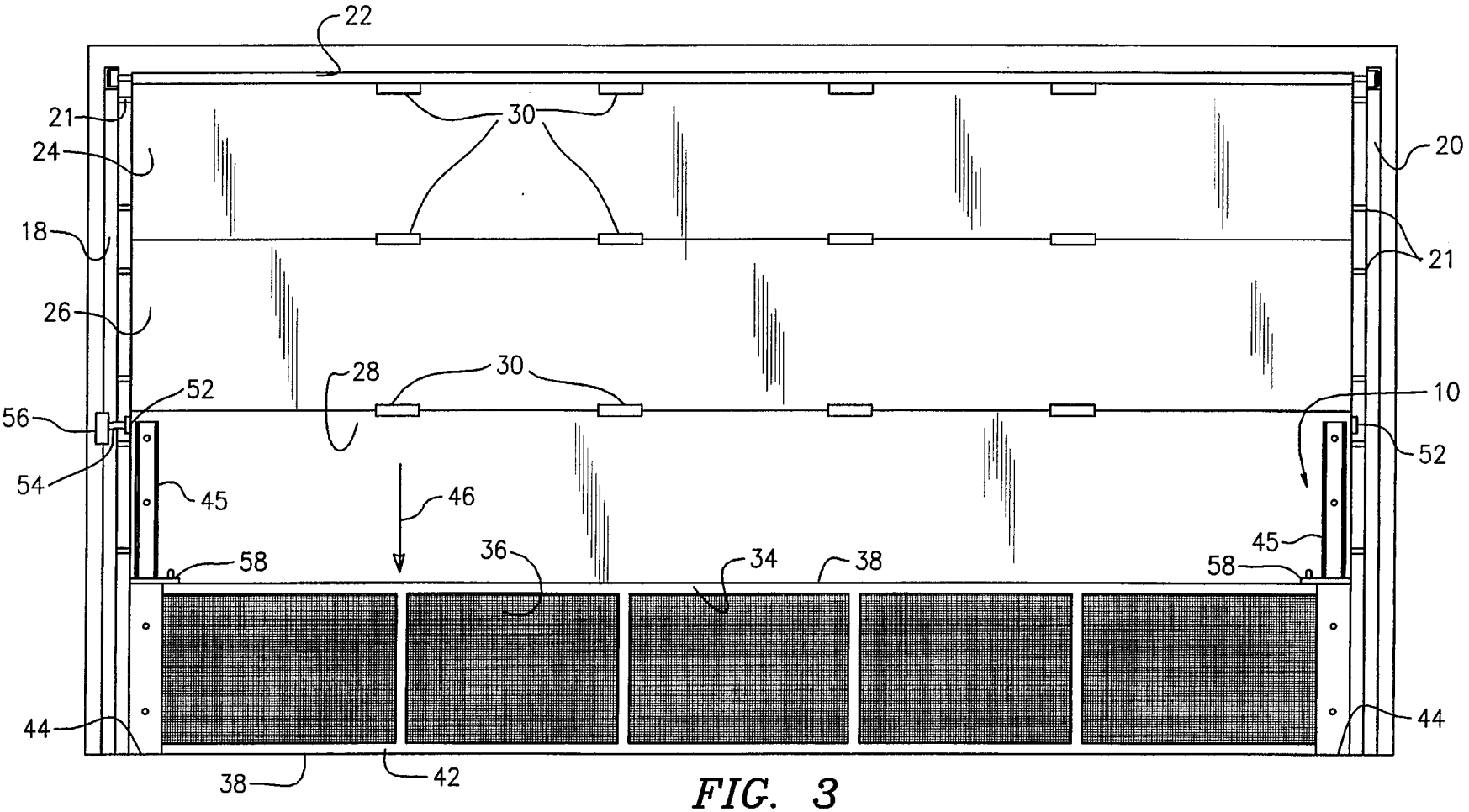
FIG. 3 is a front elevational view of the single panel screen assembly and garage door of FIGS. 1 and 2, with the garage door raised and the screen assembly extended.

Garage door 12 is shown in a slightly raised condition in FIGS. 2 and 3. Therein, uppermost door panel 22 has moved from a vertical into a generally horizontal orientation in tracks 18 and 20. Door sections 24 and 26 are raised from their positions shown in FIG. 1 and lowermost door panel 28 is now exposed. At the same time, door panel 34 is in an extended condition. The screen panel generally depends from the lowermost edge of door section 28 such that the lowermost edge 42 of panel 34 remains in engagement with garage floor 44. As used herein "depends" does not necessarily mean that the screen panel literally hangs from door panel 28. Rather, it indicates that the panel extends downwardly from the elevated garage door to the garage floor. The screen panel is slidably mounted to vertical slide members 45 carried by the inside surface of door panel 28. The specific details of this structural interconnection are described more fully below. With door 12 is raised, FIGS. 2 and 3, panel 34 slides relative to door panel 28 in the direction of arrows 46 such that the screen panel extends generally from the bottom edge of panel 28 to garage floor 44, light and ventilation enter the garage, as indicated by arrows 50 in FIG. 2.

A pair of brackets 52, FIG. 3, are mounted to respective sides of lowermost garage door panel 28 proximate the top edge of that panel. The left-hand bracket 52 carries a magnetic cam actuator 54. This cam interengages a limit switch 56 that is mounted to the garage door casing proximate the side of the door. Such interengagement, which is explained more fully below, causes door 12 to stop at a predetermined height generally equal to that of screen panel 34. As will also be described more fully below, various types of switches and cams may be utilized. The switching mechanism may also be employed equally effectively on the right-hand side of the garage door.

A pair of latch mechanisms 58 are slidably mounted to the upper horizontal surface of screen frame 38 proximate respective lateral ends of the screen panel. These latch mechanisms, which are described in greater detail below, cooperate with respective brackets 52 to releasably lock screen panel 34 in the retracted condition illustrated in FIG. 1. The latches are released, as shown in FIGS. 2 and 3, so that the screen panel may be extended below the raised door.

Figure 4:
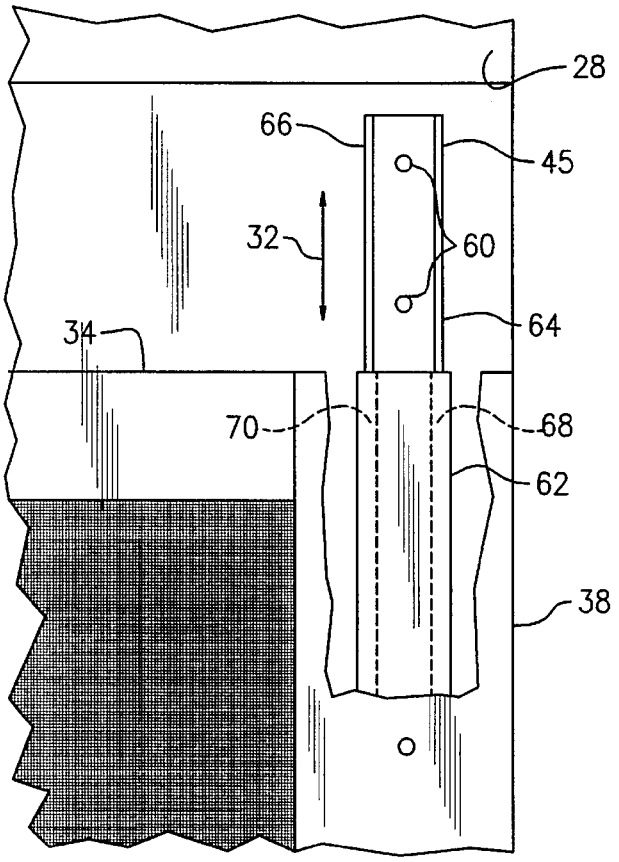
FIG. 4 is an elevational side view of a preferred slide member and complementary track member used in the screen assemblies of this invention.

As shown in FIG. 4, each slide member 45 is mounted to the inside surface of garage door panel 28 by a pair of bolts 60. Each slide member is slidably received in a conventional manner by an elongate vertical track member 62 that is mounted to a vertical component of screen assembly frame 38. The cooperating slide member 45 and track member 62 feature a standard construction used in numerous types of sliding devices such as desk drawers. Specifically, slide member 45 includes a pair of lips or ribs 64 and 66 that are respectively received in slots 68 and 70 of track member 62. The slide member and track member should be selected so that smooth, interference-free sliding in the direction of double-headed arrow 32, is provided between screen panel 34 and lowermost door panel 28. The complementary slide and track members are illustrated at the lateral ends of garage door panel 28 and screen panel 34 in FIGS. 2 and 3. However, it should be understood that, in alternative embodiments, the track members may be mounted to the inside surface of vertical members 40, FIG. 1. In such cases, the slide members 45 are mounted along the inside surface of door panel 28 in respective positions such that they align with vertical members 40 and the track members 62 carried thereby. In still other embodiments, the slide members may be mounted to the screen panel and the track members may be mounted to the garage door panel.

Figure 5:
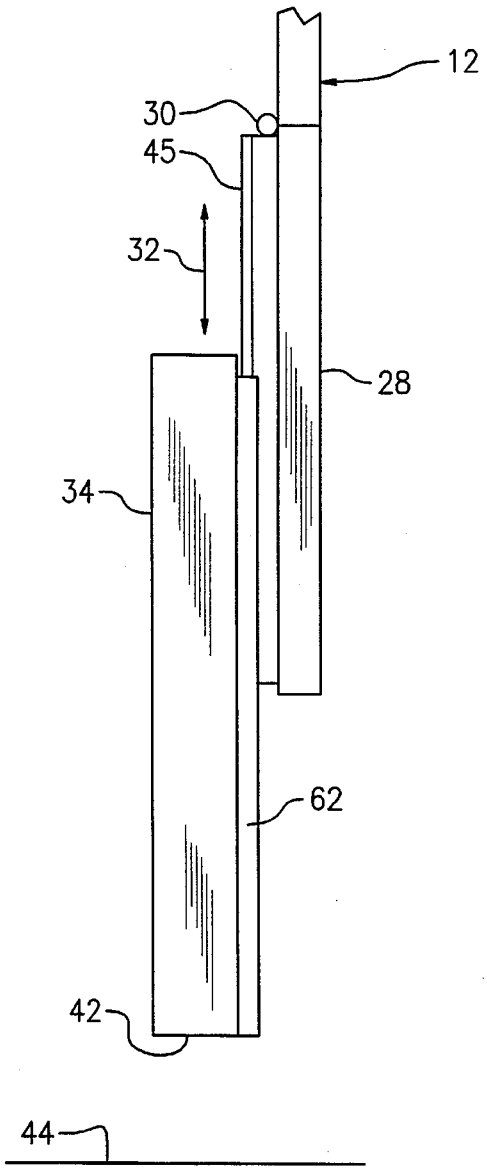
FIG. 5 is an elevational side view of the single panel screen assembly in the extended condition.

Slidable cooperation between screen panel 34 and door panel 28 is further illustrated in FIG. 5. Slide member 45 is mounted on the inside surface of door panel 28 and extends to a point just below the upper edge of that panel. Track member 62 is slidably mounted on slide member 45 such that screen panel 34 is selectively raised and lowered relative to door panel 28, as illustrated by double headed arrow 32. With the screen panel fully extended, the lower edge 42 of screen assembly 34 engages garage floor 44. The track and slide members may include appropriate known structure that restricts those components from separating in the fully extended condition.

Figure 6:
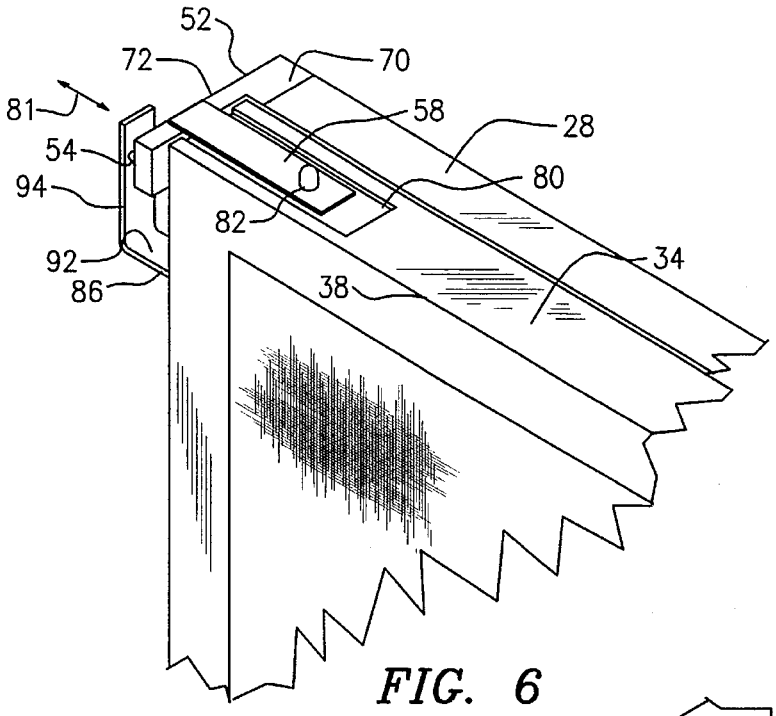
FIG. 6 is a perspective view of the means for releasably locking a single screen panel to the inside surface of the garage door.

As illustrated in FIG. 6, bracket 52 is secured to the outside edge of door panel 28 proximate the upper edge of the door panel. The panels located above lowermost panel 28 are omitted for clarity. The bracket is secured to door panel 28 by bolts, adhesive or other appropriate means. Bracket 52 has a generally L-shaped configuration including, particularly, a first section 70 that extends laterally outwardly from door panel 28 and a second section 72 that extends perpendicularly from section 70 in an inward direction from the garage door. Section 72 is disposed laterally outside of screen panel 34. A resilient actuator cam element 54, which comprises for example an integral spring, is carried by the outside surface of bracket section 72. The bracket is preferably composed of a rugged and durable metal. Various other types of plastics and wood may be utilized.

Latch 58 is slidably mounted to the upper surface of screen assembly frame 38. More particularly, latch 58 is slidably mounted in a corresponding slot 80 formed in the top surface of frame 38. This structure resembles various types of gate and door latches. Lug 78 is slidable within slot 80 in the directions of double-headed arrow 81. A handle 82 extends upwardly from latch 58 to permit the latch to be slid longitudinally back and forth within the slot. The latch may have runners that fit in complementary channels within slot 80 to prevent the latch from being lifted out of the slot. The latch is alternatable between a locked condition wherein it extends laterally beyond screen panel 34, as shown in FIG. 6, and an unlocked condition wherein latch is slid to the right such that it does not extend laterally beyond the screen panel. The functioning of the latch in the unlocked condition is described more fully below. With the latch in the locked condition, shown in FIG. 6, the distal end of latch 58 engages the upper surface of bracket 52. As previously described in connection with FIG. 3, a similar sliding latch 58 and L-shaped bracket 52 are employed on the opposite side of the garage door and screen panels respectively. As a result, when the latches 58 are slid outwardly into the locked condition, panel 34 is locked in a retracted position against door panel 28. The screen panel is held raised relative to the door panel in the manner shown in FIGS. 1 and 6. Ventilation is not provided through the screen. Rather, the screen is stacked against and raised and lowered with the garage door.

Figure 7:
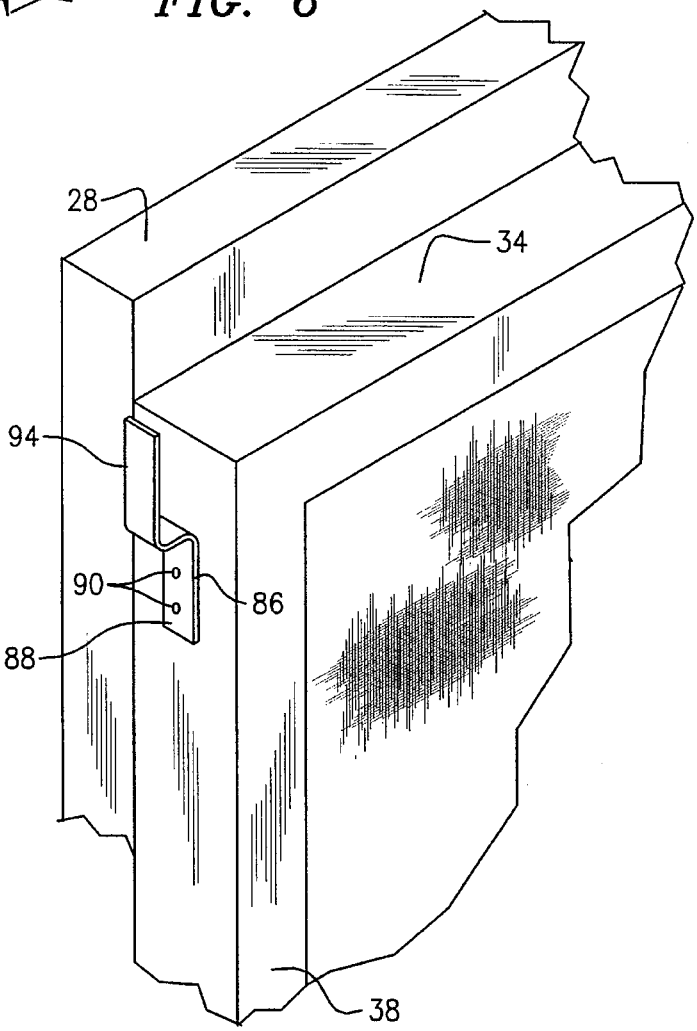
FIG. 7 is a perspective view of the guard element attached to the side of the screen panel.

A metallic or plastic guard member 86 is attached to the side of screen panel 34 and extends upwardly and outside of resilient cam actuator 54. The one piece guard member, also shown in FIG. 7, includes a generally flat first portion 88 that is secured to a side of the screen panel frame 38 by a pair of rivets or screws 90. A horizontal section 92 extends laterally of panel 34 and an outer vertical section 94 extends upwardly from section 92. As best shown in FIG. 6, section 94 extends in front of actuator cam 54. Guard member 86 operates to prevent cam 54 from engaging the garage door limit switch when the screen panel 38 remains retracted against the garage door panel and the door is raised so that the garage door is allowed to fully open without deploying the screen.

Figure 8:
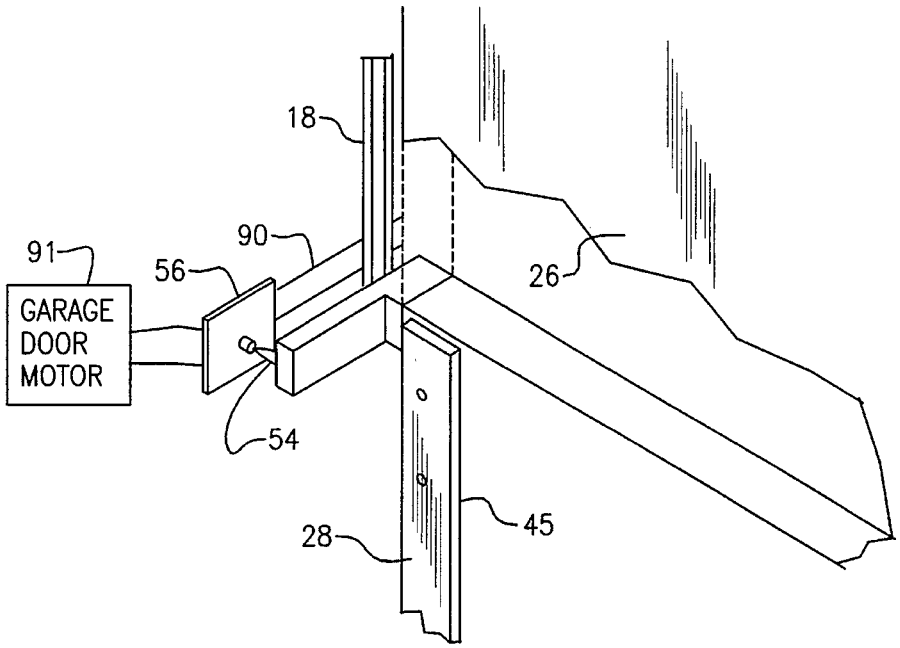
FIG. 8 is a perspective view of a microswitch or toggle switch being actuated by a cam carried by the garage door to stop the garage door at a predetermined height.
Figure 9:
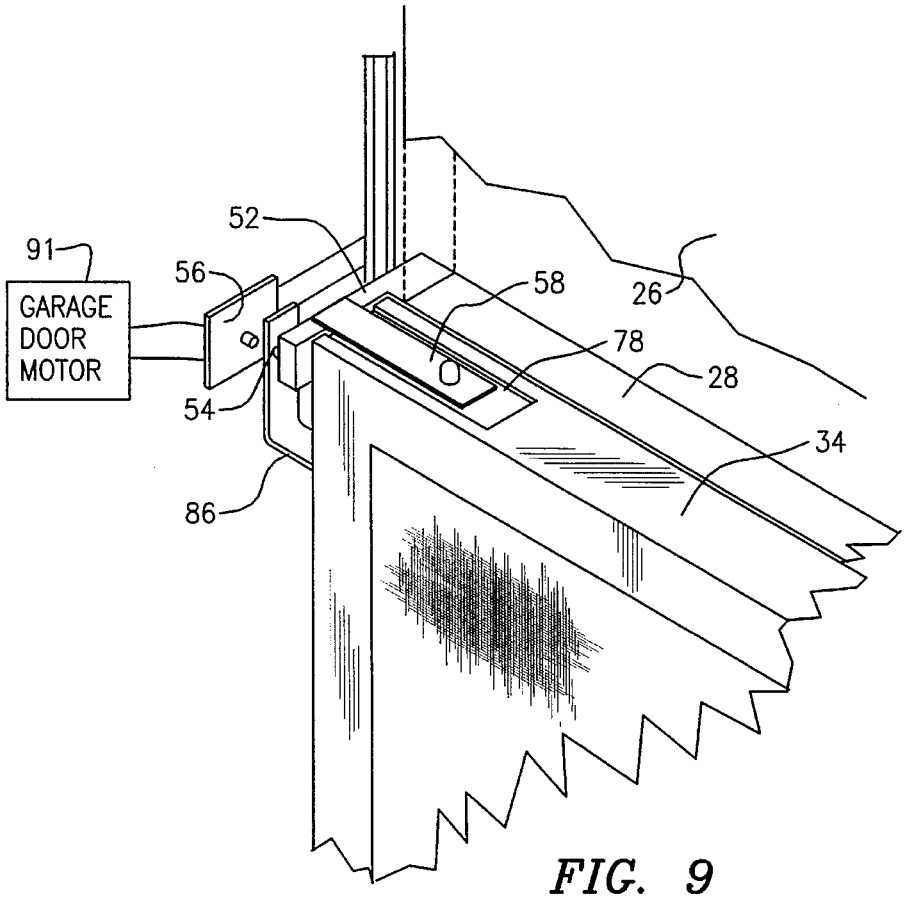
FIG. 9 is a perspective view of the single screen panel locked against the garage door, the cam being blocked by the guard member and raised with the garage door past the switching mechanism such that the garage door is allowed to fully open.

The garage door may be raised in one of the alternative ways illustrated in FIGS. 8 and 9. In some cases, the homeowner may desire to deploy screen assembly 10 so that improved garage ventilation is provided. In such a case, latch 58, FIG. 6, is unlocked by grasping handle 82 and sliding the latch toward the inner end of its respective slot 80. This operation, which is performed for both of the latches 58, disengages the latches from their respective brackets 52. As a result, screen panel 34 is free to slide downwardly relative to garage door panel 28. The homeowner then raises the garage door by activating an appropriate conventional garage door opener. As the door rises, screen panel 34 automatically slides downwardly relative to door 12, as indicated by arrow 46 in FIG. 3, and into the extended condition. In other words, the bottom edge 42 of screen assembly 34 remains engaged with garage floor 44 while door 12 is elevated. Because guard member 86 remains secured to the screen panel, bracket 52 and cam 54, which are carried by garage door panel 28, are raised clear of guard member 86. As a result, the cam member 54 is exposed and springs laterally outwardly. Eventually, as illustrated in FIG. 8, the upper edge of door panel 28 is raised to a predetermined height that generally corresponds to the height of screen panel 34. This is also approximately the height at which switch mechanism 56 is mounted to the garage door casing. Such mounting is accomplished, for example, by a metal bracket 90 that extends behind garage door track 18 and is secured-to the casing by bolts, screws or other appropriate means. In FIGS. 8 and 9, switch mechanism 56 is a conventional microswitch or toggle switch electrically interconnected to an otherwise standard automatic garage door motor 91. The switch is alternatable between a first state wherein motor 91 is activated and a second state wherein the motor is deactivated to stop movement of the garage door. When door panel 28 reaches the predetermined height, cam actuator 54 operably engages switch 56 as shown. As a result, switch 56 is alternated from the first to the second state and the garage door motor is deactivated. This causes the garage door to be stopped at the predetermined height. As stated, this height is approximately equal to that of the screen panel assembly 34 illustrated in FIGS. 2 and 3. The homeowner can then allow the garage door and screen assembly to remain in this open position, with the screen panel depending from the garage door and extending between panel 28 and floor 44, for as long as needed to provide ventilation and lighting to the interior of the garage. To subsequently close the garage door, the homeowner re-activates the garage door opener in a conventional manner. This causes the garage door motor to operate in a reverse direction to close the door. Specifically, the garage door is lowered and screen panel 34 slides upwardly relative to lowermost door panel 28. The track members 62, FIGS. 4 and 5, slide upwardly relative to slide members 45 until door panel 28 is fully lowered and engages garage floor 44. In this condition, screen panel 34 is stacked against the inside surface of door panel 28. During the entire operation, the lower edge 42 of screen panel 34 remains in engagement with garage floor 44.

As illustrated in FIG. 9, screen panel 34 may remain stacked and locked against door panel 28, even as the garage door is elevated. Each of the latches 58 is slid outwardly such that it engages a respective bracket 52. The latches are not unlocked as the garage door is raised. As a result, screen panel 34 is carried upwardly with lowermost door panel 28. As the screen panel is raised, guard 86 remains in front of cam 54. When door panel 28 and screen panel 34 reach the predetermined height generally equal to the height of the screen panel, guard member 86 prevents resilient cam 54 from operably engaging switching mechanism 56. As a result, the garage door motor is not deactivated. Instead, the garage door continues to rise until it is fully opened. Screen panel 34 is carried along with lowermost door panel 28 into the open condition, wherein the screen panel remains juxtaposed against the door panel. In this condition the garage door remains opened in a normal manner so that persons and vehicles can pass through the garage door opening without interference from the screen. If use of the screen is subsequently desired, the garage door is simply fully closed and the latching mechanism opened so that the screen panel can then be deployed in the manner previously described.

Figure 10:
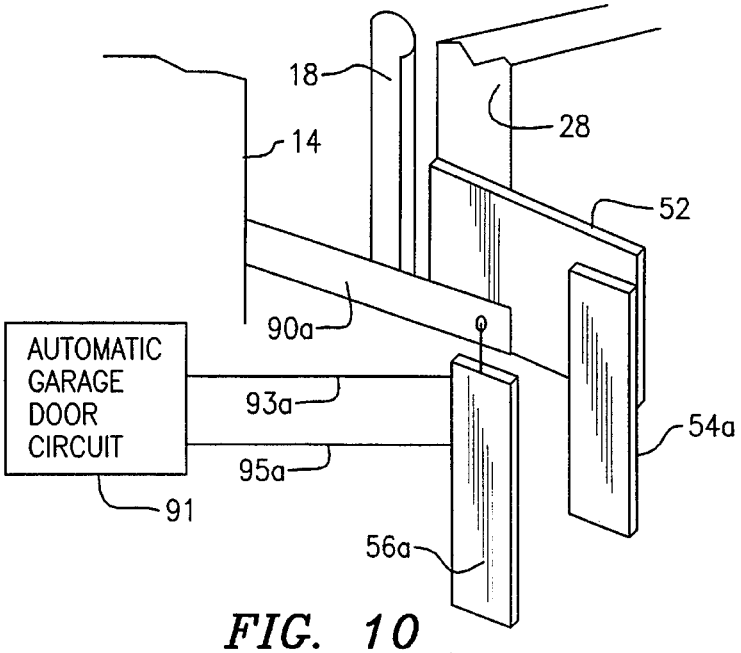
FIG. 10 is a perspective view of an alternative preferred magnetic switching mechanism and switch actuator.

An alternative switching mechanism is shown in FIG. 10. Therein, a magnetic switch **56*a*, which may comprise various known types of magnetic switches, is mounted to a door casing 14 by a bracket 90*a*. Switch 56*a* is connected by appropriate wires 93*a* and 95*a* to garage door motor 91. Lowermost garage door panel 28 carries bracket 52, as previously described. A magnetic component 54*a* is mounted by screw, adhesive or other appropriate means to a distal end of bracket 52. Magnetic component 54*a* exerts a magnetic force sufficient to actuate magnetic switch 56*a* by alternating that switch from a first state wherein the motor 91 is activated to a second state wherein the motor 91 is deactivated. The remainder of the switching assembly is analogous to that previously described. Initially, with the screen panel attached to door panel 28, a guard member covers magnetic component 54*a*. However, when the screen panel is unlocked from the door panel and slides downwardly relative thereto, magnetic component 54***a* is exposed. As a result, when the garage door is raised to the predetermined level, magnetic component 54*a* is disposed adjacent to switching mechanism 56*a*. This causes the switching mechanism to switch from the first state to the second state so that the garage door is stopped at the predetermined height. In alternative embodiments various other types of known switching mechanisms may be utilized for controlling the operation of the automatic garage door motor.

Figure 11:
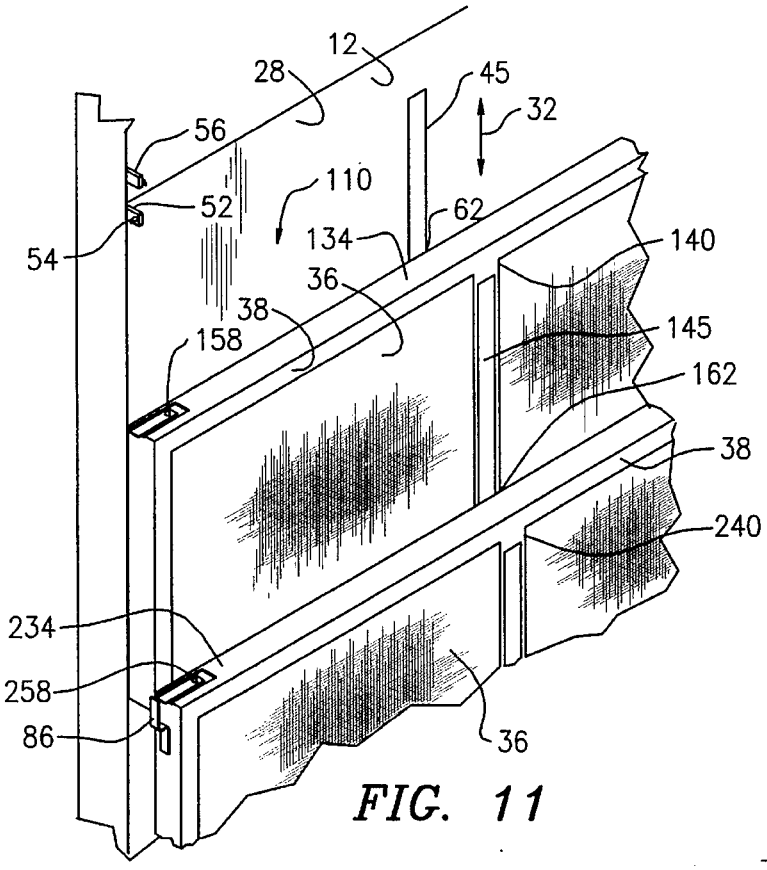
FIG. 11 is a perspective view of an alternative double panel screen assembly according to this invention.

There is shown in FIG. 11 an alternative assembly 110 of this invention which employs a pair of screen panels 134 and 234 telescopically mounted to the inside surface of garage door 12. The principles utilized with multiple screen panel embodiments are basically the same as those employed for the single panel embodiment. Specifically, each of the panels 134 and 234 includes an interior screen mesh 36 that is surrounded by a peripheral frame 38. The screen panel can be divided into a plurality of panel segments, each separated by a vertical member 40. In FIG. 11 only the left-hand segment of each panel is shown. As in the prior embodiment, each of the panels extends laterally across the entire width of the garage door.

Upper screen panel 134 is stacked directly against and generally parallel to lowermost door panel 28. Panel 134 is slidably mounted to the inside surface of door panel 28 by one or more slide and track assemblies, as previously described. Typically, a plurality of vertical slide members 45 are mounted to the inside surface of door panel 28 and a complementary track member 62 is mounted to panel 134 for slidably interengaging each slide member 45. In the embodiment of FIG. 11, track member 62 is carried by the inside surface of vertical member 40 and slide member 45 is disposed between the sides of the garage door. One or more additional slide members and complementary track members may be utilized between upper panel 134 and garage door panel 28. Various types of slidable mounting arrangements may be employed, as previously described.

Lower panel 234 is slidably mounted in a similar manner to the inwardly facing surface of upper panel 134. Specifically, one or more slide member 145 are mounted to the inside surface of the frame (specifically member 140) of panel 134. Slide members 145 are slidably received in complementary track members 162 mounted to the outward surface of respective vertical members 240 of screen panel 234. Slide members 145 and track members 162 operate analogously to the above described slide members 45 and track members 62. This enables innermost screen panel 234 to slide upwardly and downwardly relative to upper screen panel 134, as indicated by double-headed arrow 32. Again, varying numbers of slide members and complementary track members may be provided between the upper and lower screen panels along selected vertical components of the respective frames.

Figure 12:
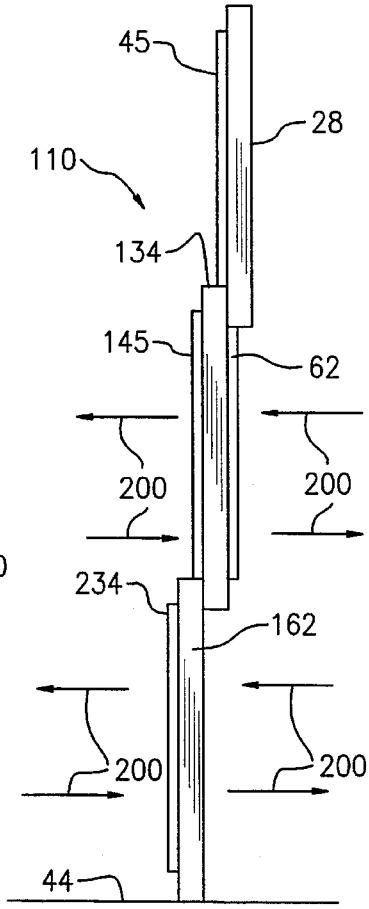
FIG. 12 is a side view of the double panel screen assembly with the screen panels fully extended to permit improved ventilation of the garage.

By interconnecting the upper and lower panels and mounting those panels to the garage door in the above described manner, screen assembly 110 is allowed to operate telescopically relative to the garage door. The fully deployed panels are illustrated in FIG. 12. Specifically, upper panel 134 carries one or more outwardly facing track members 62 and inwardly facing slide members 145. Each track member 62 slidably receives a respective slide member 45 mounted on the inside surface of garage door panel 28. Screen panel slide member 145 is similarly longitudinally slidably engaged with a respective track member 162 carried by the outwardly facing frame surface of screen panel 234. This telescoping interconnection enables the screen panels 134 and 234 to alternate between retracted and an extended conditions. In the extended condition, shown in FIG. 12, screen panel 134 depends from the lower edge of door panel 28. Similarly, lower screen panel 234 extends between upper panel 134 and garage floor 44. When the garage door is raised to a predetermined height, generally equal to the height of the extended panels 134 and 234 as shown, the panels automatically slide, under the force of gravity, into the extended condition. As a result, air is allowed to circulate through the panels and into and out of the garage, in the manner indicated by arrows 200. Subsequently, the garage door, including panel 28, can be lowered to directly engage floor 44. This causes track members 62 to slide upwardly relative to slide members 45. Track members 162 similarly slide upwardly relative to slide members 145. The screen panels 134 and 234 are then stacked against the inside surface of lowermost garage panel 28. They are conveniently and neatly stored in this condition until use of the screen panels is subsequently required. Storage problems and garage clutter are thereby reduced.

The multiple screen panel embodiment also includes a number of the other features that have been previously described. For example, as illustrated in FIG. 11 a bracket 52 carrying a cam actuator 54 is mounted to the side of lowermost door panel 28. Actuator 54 engages limit switch 56 when the door has reached the predetermined height of the screen panels 134 and 234 in their extended open condition. Screen panels 134 and 234 are also provided with respective latches 158 and 258 that selectively interengage brackets 52 to hold the panels in a releasably locked condition. Again, a sliding latch may be provided at each end of each screen panel. With the latches in a locked condition, wherein they engage respective brackets 52, the garage door 12 may be raised and lowered without deploying the screen panels. Rather the screen panels are carried with and remain stacked against the lowermost door panel 28. Alternatively, when the homeowner desires to open screen assembly 110, latches 158 and 258 are slid inwardly to disengage them from brackets 52. As the garage door is raised, the screen panels slide downwardly relative to garage door panel 28 and extend telescopically downwardly from the bottom edge of the garage door to the floor of the garage. The lower screen panel 234 carries a guard member 86. With the screen panels released from the garage door, actuator cam 54 is raised from behind guard member 86 and fully exposed. As a result, when the garage door reaches its predetermined height and the screen panels are fully extended, the cam actuator engages switch 56 to stop the garage door at its predetermined, partially opened height. If, alternatively, the screen panels 134, 234 remain locked to door panel 28, guard member 86 continues to cover cam actuator 54 while the door is raised and prevents the cam from engaging switch 56. As a result, the garage door fully opens and is not stopped at a partially opened height. As in the prior art embodiment, the garage door is re-closed from a fully or partially open condition by simply reactivating the automatic garage door opener in a conventional manner. This directs the garage door motor to reverse direction and close the door.

Figure 13:
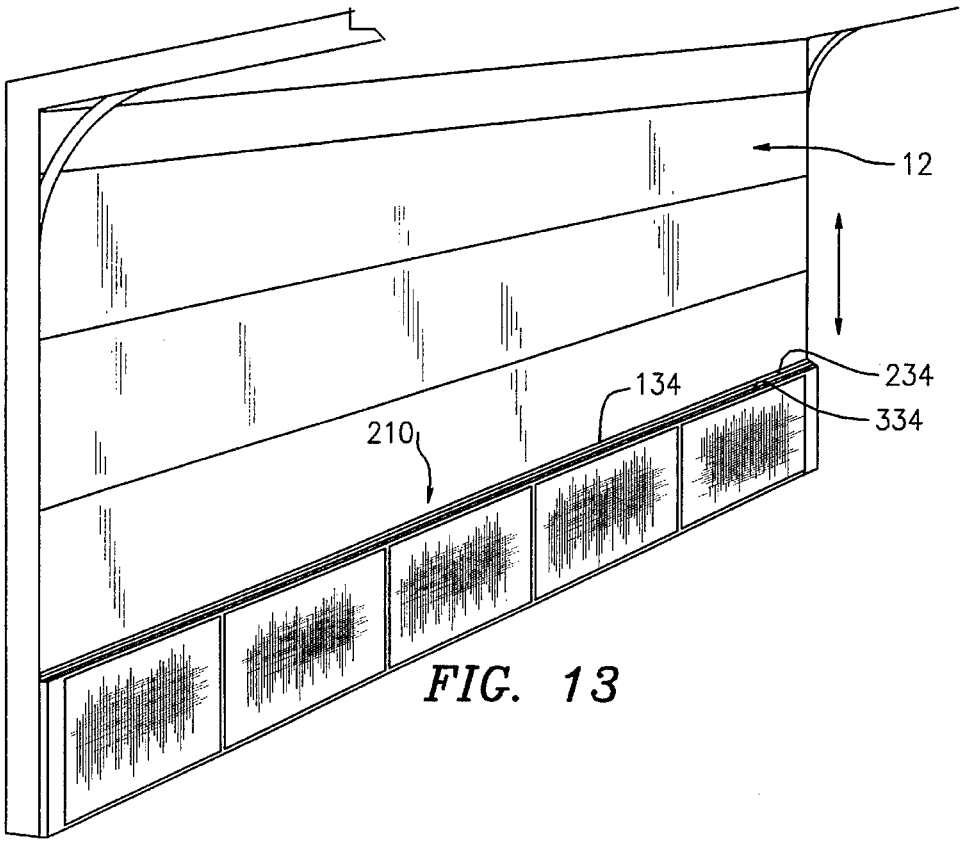
FIG. 13 is a perspective view of a three panel screen assembly according to this invention, with the garage door closed and the screen assembly fully retracted.
Figure 14:
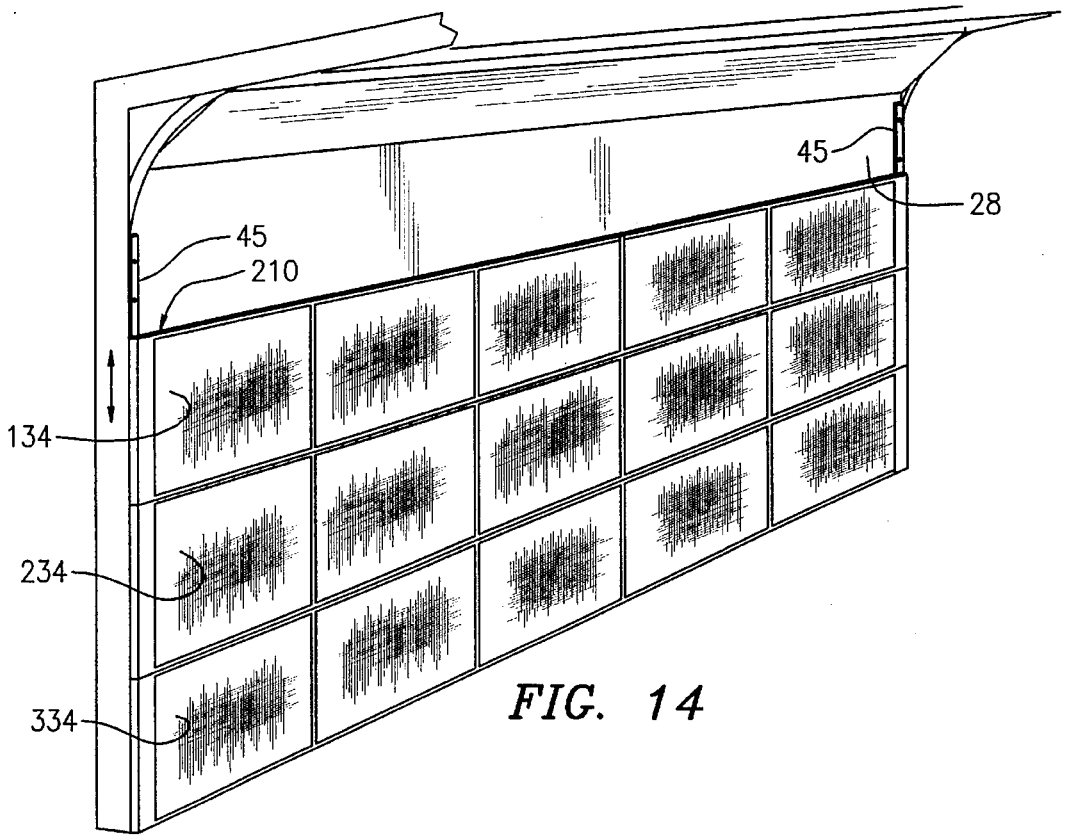
FIG. 14 is a perspective view of the embodiment of FIG. 13 with the garage door fully raised and the three-panel screen assembly fully extended.

There is shown in FIGS. 13 and 14 a retractable screen assembly 210 that employs three telescopically interconnected screen panels 134, 234 and 334 mounted to the inside surface of the bottom garage door panel 28. Each of the panels is constructed analogously to the panels in the above described embodiments. The uppermost screen panel 134 is again slidably mounted to the inside surface of door panel 28 by appropriate slide members 45 secured to door panel 28 and complementary track members, not shown, mounted to the outside frame surfaces of panel 134. In FIG. 14, slide members 45 are again positioned along the side edges of the door panel 28. Complementary slide members and track members are also employed to slidably interconnect panel 134 and lower panel 234. Additional lower panel 334 is interconnected in an identical manner to panel 234. For example, one or more generally vertical slide members may be secured to the outer frame surface of panel 234 and complementary track members may be attached to the inner frame surface of panel 334 for operably and respectively interengaging those slide members. Essentially, panel 134 slidably interengages panel 234 and lowermost panel 334 slidably engages panel 234 in a manner that is identical to that previously described for the interengaged panels in the embodiment of FIGS. 11 and 12. An analogous track and slide member construction may be employed for all embodiments of this invention.

When garage door 12 is closed, as shown in FIG. 13, screen panels 134, 234 and 334 retract into a stacked condition wherein each of the screen panels is juxtaposed against and substantially parallel to the lowermost door panel of the garage. In this condition, latch mechanisms, as previously described, or other locking mechanisms may be utilized to interlock the respective screen panels together and to the inside surface of the garage door. The garage door mounted bracket, screen panel mounted guard member and switching mechanisms set forth in the previously described embodiments may likewise be used in this version. Assembly 210 may be opened to provide a three panel screened doorway by unlocking the latches or other locking mechanisms to release screen panels 134, 234 and 334 from the garage door. As the door 12 is raised, the door panels telescopically open from the condition shown in FIG. 13 to that shown in FIG. 14. At this predetermined height, the previously described switching mechanism is actuated, such as by a cam or magnetic actuator, and further movement of the garage door 12 is halted. Fresh air and sunlight are thereby permitted to enter the garage.

Subsequently, the garage door is lowered by re-activating the automatic garage door controls to reverse the garage door motor. As the door is lowered, the screen panels telescopically collapse into the retracted condition shown in FIG. 13 such that they are again stacked against the inside surface of the lowermost door panel.

The three panel embodiment provides virtually maximum ventilation through the garage doorway. Such an assembly enables certain garages to serve as an additional porch or screen enclosure. An effectively ventilated screened area is provided that is well lighted and ventilated. At the same time, insects and other pests are prevented from entering the garage. Privacy and security are also maintained. It is expected that the assembly of this invention will conform to virtually all known restrictive covenants and requirements of homeowner's associations.

The retractable screen assembly of this invention may also be used effectively for manually operated garage doors. Before the door is raised, the screen panel(s) are again unlocked so that they are freely slidable relative to the garage door. The garage door is them manually raised to a height corresponding to the height of the panel(s) in an extended condition. The assembly is particularly useful, however, in conjunction with automatically controlled garage doors. The screen panels are deployed and retracted almost entirely through the automatic operation of the garage door. The only manual operation that is required is locking and unlocking the screen panels relative to the garage door.

It should be noted that various alternative structural details may be employed within the scope of this invention. For example, various alternative types of latching mechanisms may be employed. The latches may be constructed similar to latches used on conventional screen doors so that the screen panels and lowermost garage door panel are automatically interlocked when the panels are collapsed into their retracted condition. Such a feature eliminates virtually all manual intervention and makes the assembly fully automatic. Additionally, the latches or other locking means may be located along the screen panel at locations other than at the ends of the panel. As stated, a variety of limit switches may be used to stop the garage door at the desired height and, likewise, various types of track assemblies may be utilized for slidably interconnecting the stacked panels. The precise dimensions of the screen panels and the number of panels and panel sections employed is wholly variable within the scope of this invention. Multiple panel versions provide increased ventilation and permit improved, versatile use of the garage. A single panel embodiment is particularly effective for communities that do not permit homeowners to leave their garage doors open more than one garage door panel high. Because the homeowner can select the number of panels that he wishes to use, this system is extremely versatile and will suit almost any homeowner's ventilation and garage usage requirements.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A retractable screen assembly in combination with a standard garage door that is selectively raised and lowered to open and close a garage, said assembly comprising:

a screen panel that extends across an inside surface of the garage door;

means for slidably mounting said screen panel to the inside surface of the garage door such that said panel is alternatable between a retracted condition wherein said panel is held in substantially parallel juxtaposition against the garage door, with at least a majority of said panel positioned substantially above a bottom edge of the garage door, and an extended condition wherein said panel depends from the lower edge of the garage door and engages a floor of the garage when the garage door is raised;

means for releasably locking said panel in said retracted condition to permit the garage door to be raised with said panel in said retracted condition, said means for locking being selectively released to permit said panel to slide into said extended condition when the garage door is raised;

means for automatically raising the garage door; and means for deactivating said means for raising to stop the garage door in a predetermined position, said means for deactivating including switch means for alternating between a first state in which said mean for raising are activated and a second state in which said means for raising are deactivated, and switch actuator means attached to the garage door for engaging said switch means and alternating said switch means from said first state to said second state to deactivate said means for raising when the garage door is in said predetermined raised position.

2. The assembly of claim 1 in which said means for slidably mounting include a pair of elongate, parallel track members mounted to and extending generally vertically on one of an inside surface of the garage door and an inner face of said screen panel and a complementary pair of parallel slide members attached to the other of said inside surface of the garage door and said inner face of said screen panel, each slide member being slidably engaged with a respective one of said track members.

3. The assembly of claim 1 in which said means for releasably locking include a bracket secured to and extending inwardly from the garage door laterally outside of said screen panel and a latch element slidably mounted on said screen panel and alternatable between a locked condition wherein said latch element interengages said bracket to restrict relative movement between said screen panel and the garage door and an unlocked condition wherein said latch element is disengaged from said bracket to permit relative movement between said screen panel and the garage door.

4. The assembly of claim 1 in which said switch actuator includes a cam.

5. The assembly of claim 1 in which said switch means includes one of a microswitch and a toggle switch.

6. The assembly of claim 1 in which said switch means comprise a magnetic switch and said switch actuator includes a complementary magnet.

7. The assembly of claim 1 further including a bracket secured to and extending inwardly from the inside surface of the garage door laterally outside of said screen panel; said switch actuator being carried by said bracket.

8. The assembly of claim 7 in which said switch actuator includes a cam that is mounted to said bracket and means for resiliently biasing said cam in a laterally outward direction relative to the garage door.

9. The assembly of claim 1 further including guard means attached to said screen panel for covering said switch actuator to prevent said actuator from engaging said switch means when said screen panel is in said retracted condition and the garage door is raised to said predetermined position.

10. A retractable screen assembly in combination with a standard garage door of the type that is selectively raised and lowered to open and close a garage, said assembly comprising:

a plurality of screen panels stacked against and extending across an inside surface of the garage door;

means for telescopically mounting said screen panels to the inside surface of the garage door such that said panels are selectively positioned in a retracted condition wherein said panels are held in substantially parallel juxtaposition against the garage door, with at least a majority of each panel located above a bottom edge of the garage door, and an extended condition wherein said panels depend from the garage door and extend generally between the lower edge of the garage door and a floor of the garage when the garage door is raised; and means for releasably locking said panels in said retracted condition to permit the garage door to be raised with said panels in said retracted condition, said means for releasably locking being released to permit said panels to slide into said extended condition when the garage door is raised.

11. The assembly of claim 10 in which an upper screen panel is slidably mounted to the inside surface of the garage door and a lower panel is slidably mounted to an inside surface of said upper panel.

12. The assembly of claim 11 in which said means for releasably locking include a bracket secured to and extending inwardly from the garage door laterally outside of said screen panels and as a pair of latch elements, each said latch element being slidably mounted on a respective said screen panel and alternatable between a locked condition wherein said latch element interengages said bracket to restrict relative movement between respective screen panel and the garage door and an unlocked condition where said latch element is disengaged from said bracket to permit relative movement between respective sewer panel and the garage door.

13. The assembly of claim 10 further including means for automatically raising the garage door and means for deactivating said means for raising to stop the garage door in a predetermined raised position.

14. The assembly of claim 13 in which said means for deactivating include switch means for alternating between a first state in which said means for raising, are activated and a second state in which said means for raising are deactivated, and switch actuator means attached to the garage door for engaging said switch means and alternating said switch means from said first state to said second state to deactivate said means for raising when the garage door is in said predetermined raised potion.

15. The assembly of claim 13 further including a bracket secured to and extending inwardly from the inside surface of the garage door laterally outside of said screen panel; said switch activation being carried by said bracket, and guard means attached to one of said screen panels for covering said switch actuator to prevent said switch actuator from engaging said switch means when said screen panels are in said retracted condition and the garage door is raised.

16. The assembly of claim 14 which said switch means comprise a magnetic switch and said switch actuator includes a complementary magnet.

17. The assembly of claim 11 in which said means for telescopically mounting include a first pair of elongate parallel track members mounted to and extending generally vertically on one of the inside surface of the garage door and an inner face of said upper screen panel and a complementary first pair of parallel slide members attached to the other of said inner surface of said garage door and said inner face of said upper screen panel, each said slide member of said first pair being slidably engaged with a respective track member of said first pair of track members and further including a second pair of elongate parallel track members attached to and extending generally vertically on one of an outer face of said upper screen panel and an inner face of said lower screen panel and a complementary second pair of parallel slide members attached to the other of said outer face of said upper screen panel and said inner face of said lower screen panel, each said slide member of said second pair being slidably engaged with a respective track member of said second pair of track members.

* * * * *